US006178765B1

(12) United States Patent
Hironaka et al.

(10) Patent No.: US 6,178,765 B1
(45) Date of Patent: Jan. 30, 2001

(54) AIR CONDITIONER HAVING AIR CLEANING FUNCTION

(75) Inventors: Yasumasa Hironaka; Takao Sakaue, both of Osaka (JP)

(73) Assignee: Funai Electric Co., Ltd., Osaka (JP)

( * ) Notice: Under 35 U.S.C. 154(b), the term of this patent shall be extended for 0 days.

(21) Appl. No.: 09/310,335

(22) Filed: May 12, 1999

(30) Foreign Application Priority Data

May 13, 1998 (JP) ..... 10-129897

(51) Int. Cl.[7] ..... F28G 9/00
(52) U.S. Cl. ..... 62/303; 62/96; 62/317
(58) Field of Search ..... 62/317, 303; 96/96

(56) References Cited

U.S. PATENT DOCUMENTS 5,092,396 * 3/1992 Murano et al. ..... 62/78 X
5,290,343 * 3/1994 Morita et al. ..... 96/96 X
5,529,613 * 6/1996 Yavnieli ..... 96/96 X

FOREIGN PATENT DOCUMENTS

2248195 * 9/1991 (GB) .
56-87143 7/1981 (JP) .
56-172345 12/1981 (JP) .
57-2135 1/1982 (JP) .
401244222 * 9/1989 (JP) .

* cited by examiner

*Primary Examiner*—Corrine McDermott
*Assistant Examiner*—Chen-Wen Jiang
(74) *Attorney, Agent, or Firm*—Morgan, Lewis & Bockius LLP

(57) ABSTRACT

An air conditioner which includes therein a dust collecting device having a high voltage unit coupled to a power supply and discharge and dust collecting electrodes each coupled to the high voltage unit, and which has an air cleaning function for collecting by means of the dust collecting device dust contained in external air sucked by rotation of a fan thereby to exhaust the air thus cleaned to an outside. The air conditioner further includes a microcomputer control section (dust removing control section) which executes a dust removing mode for heating a heater provided at the dust collecting electrode to remove dust adhered to the dust collecting electrode, in which the dust removing control section executes the dust removing mode after stopping the operation of the air conditioning function.

2 Claims, 4 Drawing Sheets

AC POWER SUPPLY
RECTIFYING CIRCUIT
75
76
HIGH VOLTAGE UNIT
77
DISCHARGE ELECTRODE
42
DUST COLLECTING ELECTRODE
41
HEATER
43
FAN
30
HEATER DRIVING SECTION
82
FAN DRIVING SECTION
74
HEATING AND COOLING DRIVING SYSTEM
73
COLLECTED DUST AMOUNT DETERMINATION SECTION
80
MICROCOMPUTER CONTROL SECTION
71
ALARM SECTION
83
KEY INPUT SECTION
72
72a
72b

AIR CONDITIONER HAVING AIR CLEANING FUNCTION

BACKGROUND OF THE INVENTION

1. Field of the Invention

The present invention relates to an air conditioner which contains therein a dust collecting device having a high voltage unit coupled to a power supply and discharge and dust collecting electrodes each coupled to the high voltage unit, and which has an air cleaning function for collecting by means of the dust collecting device dust contained in external air sucked by the rotation of a fan thereby to exhaust the air thus cleaned to the outside.

2. Description of the Related Art

Recently, the demand for keeping the air within a room to be clean to maintain comfortable live space has been increasing. In order to satisfy such a demand, an air cleaner or an air conditioner having an air cleaning function has been provided.

Further, as an apparatus for realizing such an air cleaning function, conventionally there has been provided an electronic dust collecting device including a discharge electrode and a dust collecting electrode. This dust collecting device is so arranged that a high voltage is applied between the discharge electrode and the dust collecting electrode to ionize dust within the peripheral air by means of the discharge electrode, thereby to adsorb (adhere) the ionized dust to the dust collecting electrode.

However, according to the air conditioner having such a dust collecting device, the dust collecting effect thereof degrades abruptly when an amount of dust adhered to the dust collecting electrode exceeds a predetermined value. The corona discharge may occur from the tip portion of the dust adhered to the dust collecting electrode depending on the situation thereby to generate smoke and stench. In order to prevent such a phenomenon, it is required to periodically remove the dust adhered to the dust collecting electrode.

However, when the air conditioner having the air cleaning function is so arranged that the dust collecting device is attached to the rear side of a heat exchanger, a user can not clean the dust collecting device. Thus, such an air conditioner requires a system (maintenance free system) for automatically cleaning the dust collecting device contained therein.

In view of the aforesaid matter, the inventors of the present invention have proposed an air conditioner arranged in a manner that, as a system for automatically cleaning the dust collecting device, a heating section (sheath heater or the like) is provided at the dust collecting electrode so that dust adhered to the dust collecting electrode is removed by heating the heating section (that is, dust is resolved into carbon dioxide ($CO_2$) and water ($H_2O$) through the reaction with the catalyst of ceramics fused on the surface of the dust collecting electrode).

Such an air conditioner is required, at the time of executing the dust removing mode for removing the dust adhered to the dust collecting electrode by heating the heating section, to gradually resolve the dust while maintaining the resolving speed constant so as not to generate smoke and stench or the like when resolving the dust adhered to the dust collecting electrode. In order to satisfy such a requirement, it is required to strictly manage the surface temperature of the dust collecting electrode through the heating of the heating section. That is, the dust collecting electrode is required to be heated so that the surface temperature thereof increases gradually from the room temperature (about 20° C.) to about 300° C. along the temperature characteristic curve shown in FIG. 5.

In this manner, it is required to strictly manage the surface temperature of the dust collecting electrode in the dust removing mode so as not to generate smoke and stench due to the resolving of the dust.

However, if the dust removing mode is executed in parallel to the operation of the air conditioning function (that is, various kinds of operations such as a heating operation, a cooling operation, a dehumidifying operation, a blowing operation and the like), the surface temperature of the dust collecting electrode must be managed in a state where a fan rotates. Thus, there arises a problem that it is difficult to strictly manage the surface temperature of the dust collecting electrode so as to exhibit the temperature characteristic curve shown in FIG. 5. This is because the surface temperature of the dust collecting electrode is influenced by the wind generated by the rotation of the fan.

SUMMARY OF THE INVENTION

The present invention has been made so as to eliminate such a conventional problem and an object of the present invention is to provide an air conditioner having an air cleaning function capable of strictly managing the surface temperature of a dust collecting electrode in a dust removing mode thereby to surely prevent the generation of smoke and stench at the time of resolving dust adhered to the dust collecting electrode.

In order to achieve the aforesaid object, according to the present invention, there is provided an air conditioner which contains therein a dust collecting device having a high voltage unit coupled to a power supply and discharge and dust collecting electrodes each coupled to the high voltage unit, and which has an air cleaning function for collecting by means of the dust collecting device dust contained in external air sucked by rotation of a fan thereby to exhaust the air thus cleaned to an outside, the air conditioner comprising: a heating section provided at the dust collecting electrode; and a dust removing control section which executes a dust removing mode for heating the heating section to remove dust adhered to the dust collecting electrode, wherein the dust removing control section executes the dust removing mode after stopping an operation of an air conditioning function.

DETAILED DESCRIPTION OF THE PREFERRED EMBODIMENT

An embodiment of the present invention will be described with reference to the accompanying drawings.

Figure 2:
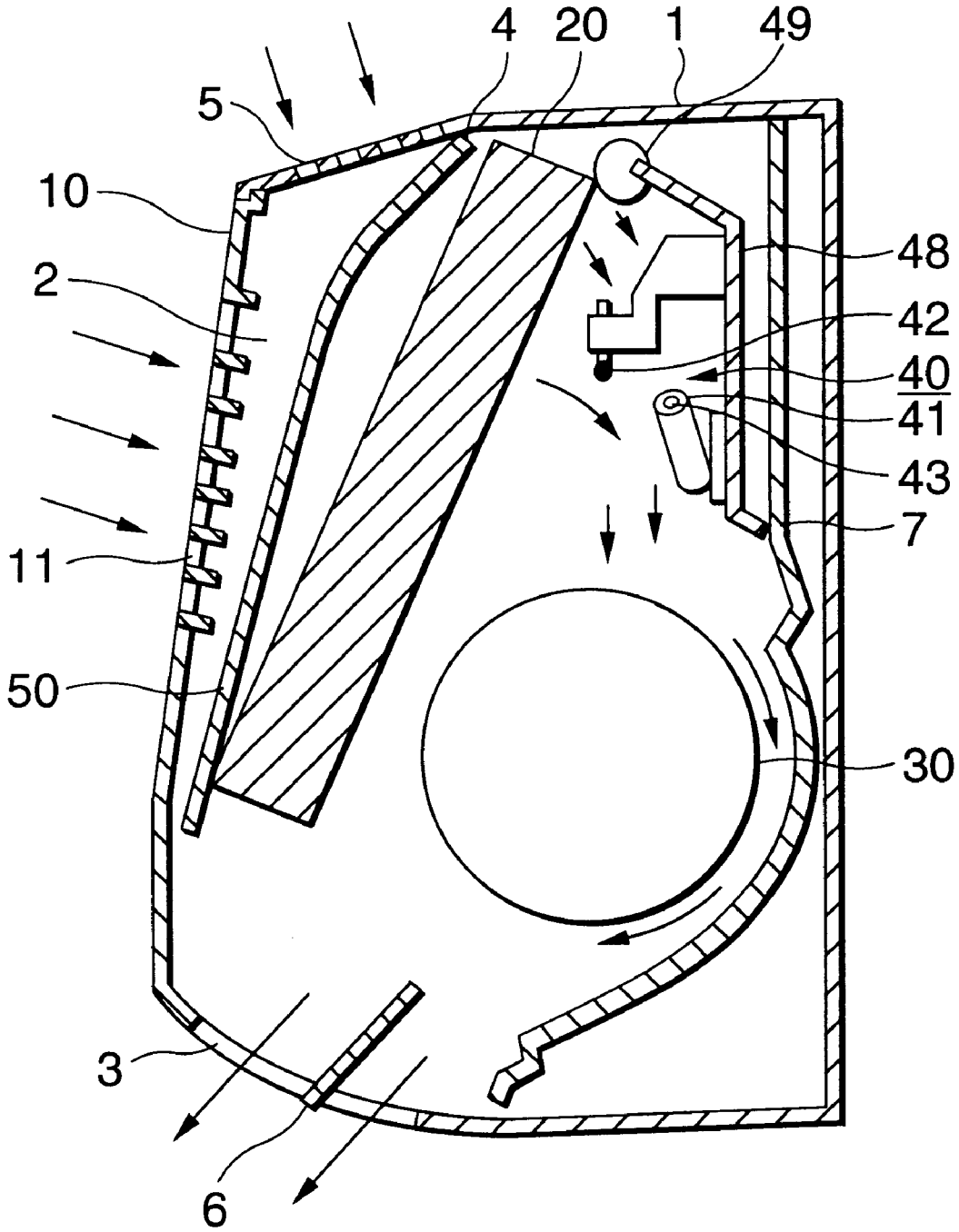
FIG. 2 is a sectional (end face) view of the air conditioner having the air cleaning function according to the present invention viewed from the side wall side thereof.

FIG. 2 is a sectional view of an air conditioner having an air cleaning function according to the present invention viewed from the side wall side thereof.

This air conditioner includes a case body 1 having an opening serving as a sucking opening 2 on a front wall thereof and an exhausting opening 3 provided beneath the sucking opening 2 (at a lower portion of the front wall), an open-close type front panel 10 attached to the sucking opening 2 of the case body 1, a heat exchanger 20 provided within the case body 1 so as to face the sucking opening 2 of the case body 1, a fan 30 of a cross flow type provided near the inner side of the exhausting opening 3 for ventilating air from the sucking opening 2 to the exhausting opening 3 through the heat exchanger 20, and an electronic dust collecting device 40 disposed at an air path on the rear side of the heat exchanger 20.

An upper grill 5 and a front grill 11 each for sucking air therein are formed in a top plate portion 4 and the front wall of the front panel 10 of the case body 1, respectively. A louver 6 of an angular adjusting type is provided at the exhausting opening 3 of the case body 1 and an air filter 50 is provided between the front panel 10 and the heat exchanger 20.

Further, a heat shielding plate 48 is attached to the surface of a vertical back plate 7 of the case body 1 and the dust collecting device 40 is attached at the front portion of the heat shielding plate 48.

Figure 3:
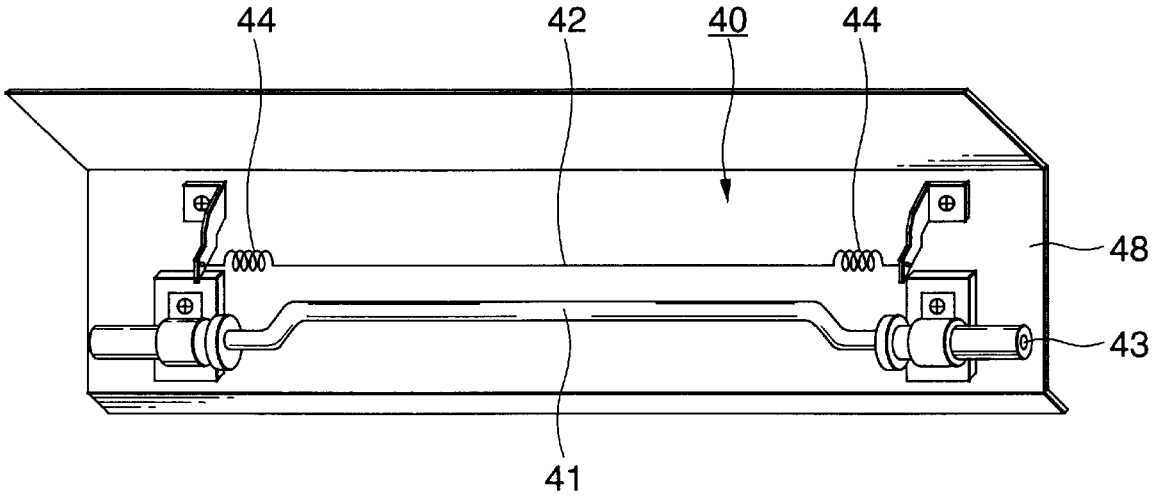
FIG. 3 is a perspective view showing a dust collecting device.

That is, as shown in FIGS. 2 and 3, the dust collecting device 40 includes a cylindrical dust collecting electrode 41 disposed to be level, a discharge electrode 42 provided to be stretched levelly at the slightly upper position on the front side of the dust collecting electrode 41, and a rod-shaped heater (sheath heater or the like) 43 for removing dust adhered to the dust collecting electrode 41. The dust collecting electrode 41 includes the heater 43 therein so that the dust collecting electrode is supported levelly by the heater 43 thus included. Springs 44, 44 are provided at the opposite end portions of the discharge electrode 42 so that the discharge electrode 42 is attached to the heat shielding plate 48 in a stretched manner. The opposite end portions of the dust collecting electrode 41 are bent to the direction away from the discharge electrode 42 in a manner that the distance between the opposite end portions of the dust collecting electrode 41 and the springs 44, 44 is kept at such a constant length not to occur discharge therebetween. The catalyst of ceramics such as alumina, zeolite or the like is fused on the surface of the dust collecting electrode 41.

According to such an arrangement, each of the dust collecting device 40 and the heat shielding plate 48 is disposed along the flow of air flowing from the upper direction to the lower direction through the air path on the rear side of the heat exchanger 20. The heat shielding plate 48 is provided at the upper end portion thereof with an insulating member 49 for preventing the heat shielding plate 48 from contacting to the heat exchanger 20.

Next, the operation of the air conditioner of the aforesaid arrangement will be described.

During the automatic operation of the air conditioner, as shown by solid arrows in FIG. 2, the air within the room flows due to the operation of the fan 30 within the case body 1 from the front grill 11 of the front panel 10 and the upper grill 5 of the case body 1, then passes through the heat exchanger 20, flows through the air path on the rear side from the upper portion to the lower portion, and is exhausted within the room from the exhausting opening 3 through the fan 30.

Figure 4:
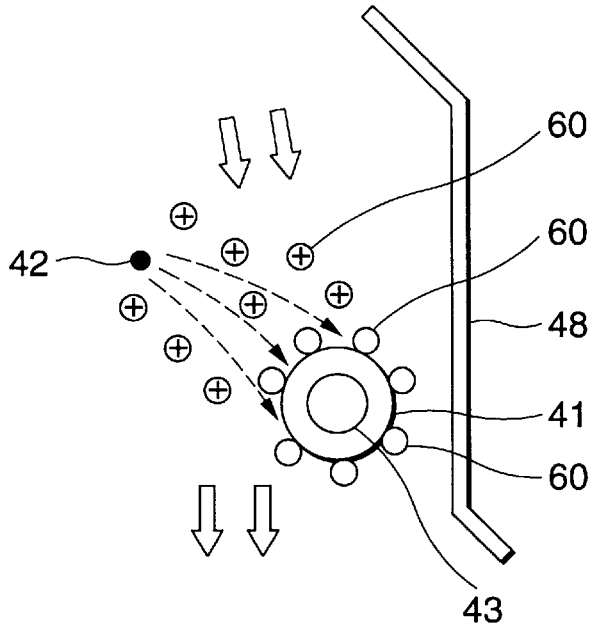
FIG. 4 is a diagram for explaining the dust collecting theory of the dust collecting device.

The dust collecting device 40 is provided at the air path on the rear side of the heat exchanger 20 and a high voltage is applied between the discharge electrode 42 and the dust collecting electrode 41. Thus, electric lines of force are generated between the discharge electrode 42 and the dust collecting electrode 41 as shown by broken lines in FIG. 4, so that dust 60 within the air near the discharge electrode 42 is ionized and attracted and adhered to the dust collecting electrode 41. As a result, the air passed through the heat exchanger 20 is cleaned when passing through the air path on the rear side thereof and again exhausted within the room.

Figure 1:
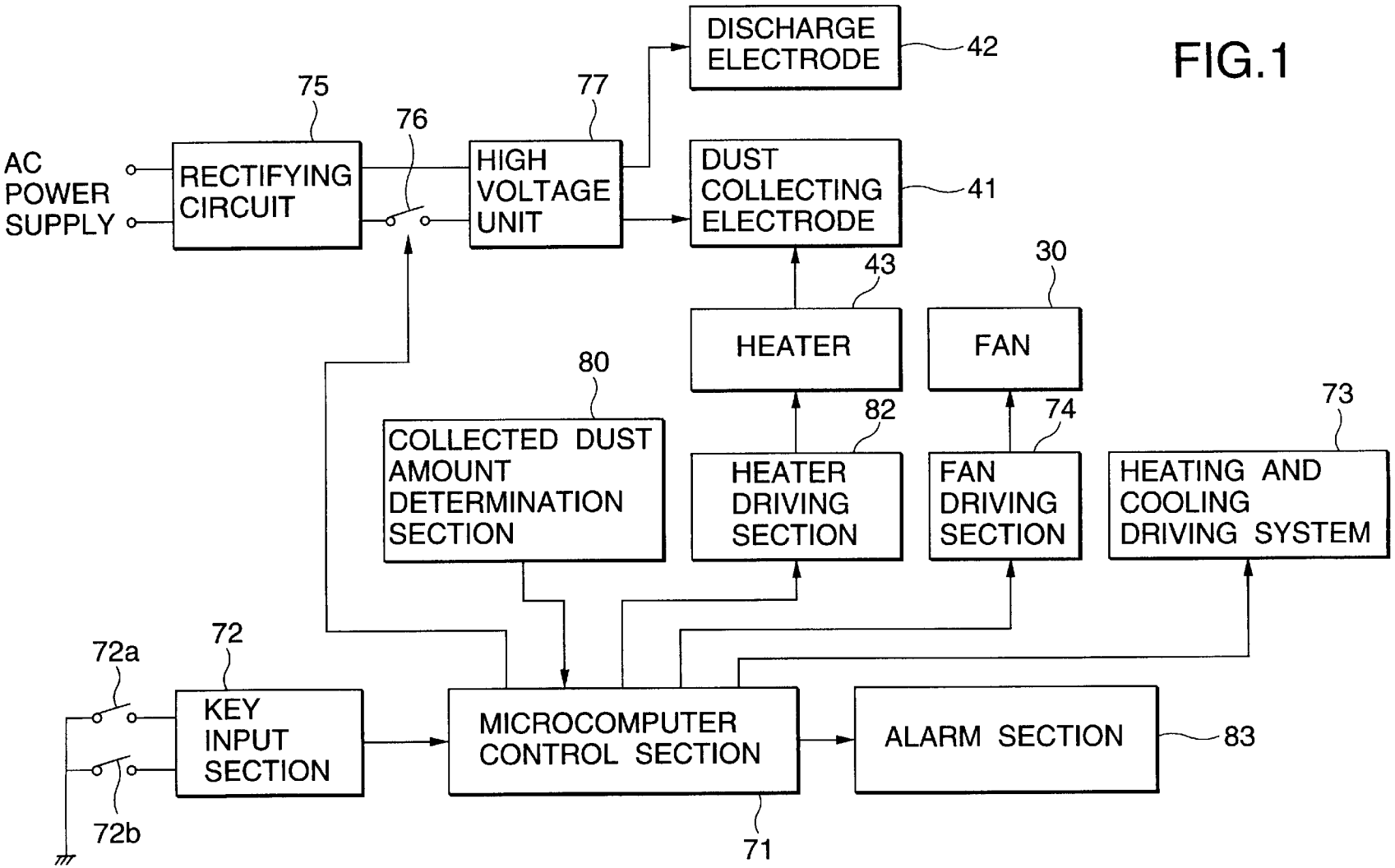
FIG. 1 is a lock diagram showing the electric arrangement of an air conditioner having an air cleaning function according to the present invention.

FIG. 1 shows the electric arrangement of the air conditioner including the circuit arrangement for executing the dust removing mode for removing the dust 60 adhered to the dust collecting electrode 41 by such an automatic operation.

That is, a key input section 72, to which various kinds of keys such as an operation key 72*a* and an operation stop key 72*b* necessary for operating the air conditioner are coupled, is coupled to microcomputer control section 71 for controlling the entire operation of the air conditioner.

The microcomputer control section 71 controls a heating and cooling driving system 73 having a not-shown well-known refrigerating cycle and also controls a fan driving section 74 thereby to rotate the fan 30 in an arbitrary rotation mode. As the rotation modes of the fan 30, three kinds of rotation modes, for example, "high", "middle" and "low" rotation modes are set.

The dust collecting device 40 is formed by a rectifying circuit 75 for rectifying the output of an AC power supply of AC 100 V, a high voltage unit 77 coupled to the rectifying circuit 75 through an open-close switch 76, and the discharge electrode 42 and the dust collecting electrode 41 each coupled to the high voltage unit 77. The microcomputer control section 71 controls the open-close switch 76 so as to open and close it thereby to apply the high voltage to the discharge electrode 42 and the dust collecting electrode 41. The microcomputer control section 71 is supplied with the output of a collected dust amount determination section 80 for determining an amount of dust adhered to the dust collecting electrode 41 (hereinafter merely referred to as a collected dust amount).

The microcomputer control section 71 controls a heater driving section 82 so as to conduct the heater 43 thereby to heat the heater 43 to remove dust adhered to the surface of the dust collecting electrode 41 (that is, dust is resolved into carbon dioxide ($CO_2$) and water ($H_2O$) through the reaction with the catalyst). The output of the microcomputer control section 71 is coupled to an alarm section 83 for notifying the stains of the dust collecting electrode 41.

The collected dust amount determination section 80 outputs an instruction signal representing a cleaning start condition of the dust collecting device 40 to the microcomputer control section 71 when a predetermined amount of dust is adhered to the dust collecting electrode 41. Here, a collected dust amount can be determined in a manner, for example, that the value of a current flowing through the primary or secondary side of the high voltage unit 77 is measured and the collected dust amount can be determined from the change of the measured current value. To be more concrete, it is considered that a current flowing through the primary or secondary side of the high voltage unit 77 increases or decreases in accordance with the amount of dust adhered to the dust collecting electrode 41. Thus, firstly, the value of a current (reference current value) flowing through the primary or secondary side of the high voltage unit 77 in a state where no dust is adhered to the dust collecting electrode 41 is set in advance. Secondarily, a difference (that is, a change value) between the reference current value and the value of a current flowing through the primary or secondary side of the high voltage unit 77 in a state where the amount of dust adhered to the dust collecting electrode 41 reaches an amount necessary for cleaning is set as a comparative current value width, in advance. Thereafter, the value of a current (measured current value) flowing through the primary or secondary side of the high voltage unit 77 during the operation is compared with the reference current value and the comparative current value width each set at the start of the operation. When the measured current value exceeds the sum of the reference current value and the comparative current value width, the collected dust amount determination section 80 outputs the instruction signal representing the cleaning start condition of the dust collecting device 40 to the microcomputer control section 71. In this respect, the method for determining the collected dust amount is not limited thereto, and the collected dust amount may be determined on the basis of the total amount of air flow, the operation time period or the like, for example. The detailed description of such other methods for determining the collected dust amount will be omitted.

The microcomputer control section 71 executes the dust removing mode at a predetermined timing on the basis of the instruction signal from the collected dust amount determination section 80. That is, the microcomputer control section 71 controls the heater driving section 82 so as to conduct the heater 43 thereby to heat the heater 43 and remove dust adhered to the surface of the dust collecting electrode 41.

The alarm section 83 is formed by a light emitting diode (LED), a buzzer, a voice synthesizing circuit, or the like. When the amount of dust adhered to the dust collecting electrode 41 reaches an amount necessary for cleaning, the alarm section turns on or blinks the LED, sounds the buzzer, or sounds a message such as "please execute dust removing mode" thereby to notify a user that the amount of dust adhered to the dust-collecting electrode has reached the amount necessary for cleaning.

Next, the operations of the dust collecting mode and the dust removing mode of the air conditioner arranged in the aforesaid manner will be described.

When the operation key 72*a* is pushed, the microcomputer control section 71 executes the automatic operation mode. To be more concrete, the microcomputer control section controls the heating and cooling driving system 73 and selectively changes the rotation speed of the fan 30 among "high", "middle" and "low" rotation modes so that the room temperature will be a preset room temperature. In this state, when the operation key 72*a* is pushed, the microcomputer control section 71 closes the open-close switch 76 to apply the high voltage to the dust collecting electrode 41 and the discharge electrode 42. On the other hand, the collected dust amount determination section 80 starts the determination of the collected dust amount on the basis of the value of a current flowing through the primary or secondary side of the high voltage unit 77.

Thereafter, the air conditioner continues the automatic operation and the dust collecting device 40 also continues the dust collecting operation (that is, a closed state of the open-close switch 76 is maintained). As a result, the amount of dust adhered to the dust collecting electrode 41 increases with the lapse of time. If the dust thus adhered to the dust collecting electrode contains moisture such as nicotine of a cigarette, a current flowing through the primary or secondary side of the high voltage unit 77 also increases as the amount of dust adhered to the dust collecting electrode 41 increases. This current value is measured as the occasion demands by a not-shown current value measuring section and the measured current value is inputted into the collected dust amount determination section 80 as the occasion demands.

The collected dust amount determination section 80 determines the amount of dust adhered to the dust collecting electrode 41 on the basis of the measured current value and both the reference current value and the comparative current value width set therein. When the collected dust amount determination section 80 determines that the collected dust amount has reached the amount necessary for cleaning, the collected dust amount determination section 80 outputs the instruction signal representing the cleaning start condition of the dust collecting device 40 to the microcomputer control section 71.

The dust removing mode executed by the microcomputer control section 71 in accordance with this instruction signal is classified into two cases, that is, (1) a case for executing the dust removing mode without rotating the fan 30 and (2) a case for executing the dust removing mode while rotating the fan 30. The description will be made as to these cases.

(1) The case for executing the dust removing mode without rotating the fan 30:

The microcomputer control section 71 executes, in accordance with the instruction signal, the dust removing mode upon the lapse of a predetermined time after stopping a cooling operation (or a heating operation) in response to the pushing of the operation stop key 72*b,* for example. In other words, the microcomputer control section 71 controls the heater driving section 82 so as to conduct the heater 43 thereby to heat the heater 43 to remove dust adhered to the surface of the dust collecting electrode 41 (that is, dust is resolved into carbon dioxide and water through the reaction with the catalyst). This dust removing mode is executed during a period in a range of about 18 minuets to 20 minuets in a manner that the dust is resolved gradually while maintaining the resolving speed of dust adhered to the surface of the dust collecting electrode 41 constant so as not to generate smoke and stench or the like at the time of resolving the dust.

Figure 5:
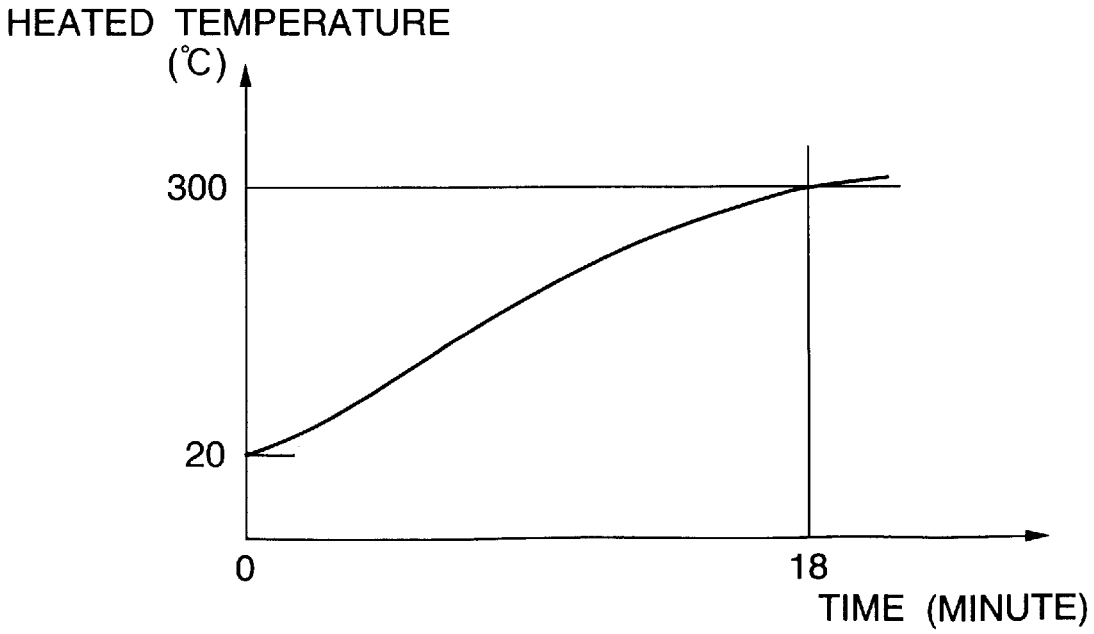
FIG. 5 is a graph showing the change of the surface temperature of a dust collecting electrode at the time of executing a dust removing mode.

In this manner, the present invention performs the dust removing mode after stopping the operation of the air conditioner (the cooling operation or the heating operation). To be more concrete, the present invention performs the dust removing mode after stopping the rotation of the fan 30 and thereby stopping the air flow within the case body 1. Thus, since the surface temperature of the dust collecting electrode 41 is not influenced by the air flowing within the case body 1, the heating operation of the heater 43 can be controlled strictly so that the surface temperature of the dust collecting electrode changes along the temperature characteristic curve shown in FIG. 5. Further, the present invention performs the dust removing mode upon the lapse of the predetermined time after stopping the operation of the air conditioning function by the following reason. The temperature within the case body 1 immediately after stopping the heating operation has been increased to about 60° C., whilst the temperature within the case body 1 immediately after stopping the cooling operation has been decreased to about 5° C. Thus, if the dust removing mode is executed immediately after stopping the air conditioning mode, since the heat starting temperature of the dust collecting electrode 41 differs greatly, the succeeding management of the surface temperature of the dust collecting electrode is very difficult and hence the resolving speed can not be maintained constant. In view of such a fact, the present invention performs the dust removing mode upon the lapse of the predetermined time after stopping the operation of the air conditioning function, whereby the dust removing mode can be executed after stabilizing the temperature within the case body 1 to a constant temperature almost same as the temperature outside of the body.

The microcomputer control section 71 drives the alarm section 83 on the basis of the instruction signal from the collected dust amount determination section 80 to turn on or blink the LED, sound the buzzer, or sound the message such as "please executes dust removing mode" thereby to notify a user that the amount of dust adhered to the dust collecting electrode has reached the amount necessary for cleaning.

(2) The case for executing the dust removing mode while rotating the fan 30:

The microcomputer control section 71 executes, in accordance with the instruction signal, the dust removing mode upon the lapse of the predetermined time after stopping the cooling operation (or the heating operation) in response to the pushing of the operation stop key 72*b,* for example. In other words, the microcomputer control section 71 controls the heater driving section 82 so as to conduct the heater 43 thereby to heat the heater 43 to remove dust adhered to the surface of the dust collecting electrode 41 (that is, dust is resolved into carbon dioxide and water through the reaction with the catalyst). In this case, the microcomputer control section 71 controls the fan driving section 74 so as to drive the fan 30 at a very low rotation speed sufficient for suppressing the increase of the temperature within the case body 1 heated by the heater 43. As a result, the air within the case body 1 is circulated little by little so as not to accumulate the heat within the body, thereby preventing the case body 1 (in particular, the top plate portion 4 of the case body 1 just above the dust collecting electrode 41) from being badly influenced (degradation of the strength or the like due to deformation or discoloration) by the heat. The fan 30 is continuously or intermittently rotated at such a low speed as about one revolution per one second, for example. This dust removing mode is executed during a period in a range of about 18 minuets to 20 minuets in a manner that the dust is resolved gradually while maintaining the resolving speed of dust adhered to the dust collecting electrode 41 constant so as not to generate smoke and stench or the like at the time of resolving the dust.

Although the present invention relates to an air conditioner, the present invention is applicable to an oil heater, an electric heater, a gas fan heater or the like of floor type having the air cleaning function.

As described above, the air conditioner having the air cleaning function according to the present invention includes the heating section provided at the dust collecting electrode and the dust removing control section which executes the dust removing mode for heating the heating section to remove dust adhered to the dust collecting electrode, wherein the dust removing control section executes the dust removing mode after stopping the operation of the air conditioning function. According to such a configuration, since the surface temperature of the dust collecting electrode is not influenced by the air flowing within the air conditioner, the surface temperature of the dust collecting electrode can be managed strictly. As a consequence, since the dust adhered to the dust collecting electrode is resolved gradually while maintaining the resolving speed thereof constant, smoke and stench or the like can be prevented from being generated at the time of resolving the dust.

What is claimed is:

1. An air conditioner which contains therein a dust collecting device having a high voltage unit coupled to a power supply and discharge and dust collecting electrodes each coupled to said high voltage unit, and which has an air cleaning function for collecting by means of said dust collecting device dust contained in external air sucked by rotation of a fan thereby to exhaust the air thus cleaned to an outside, said air conditioner comprising:

a heating section provided at said dust collecting electrode; and a dust removing control section which executes a dust removing mode for heating said heating section to remove dust adhered to said dust collecting electrode, wherein said dust removing control section executes the dust removing mode upon lapse of a predetermined time after stopping an operation of an air conditioning function.

2. An air conditioner which contains therein a dust collecting device having a high voltage unit coupled to a power supply and discharge and dust collecting electrodes each coupled to said high voltage unit, and which has an air cleaning function for collecting by means of said dust collecting device dust contained in external air sucked by rotation of a fan thereby to exhaust the air thus cleaned to an outside, said air conditioner comprising:

a heating section provided at said dust collecting electrode; and a dust removing control section which executes a dust removing mode for heating said heating section to remove dust adhered to said dust collecting electrode, wherein said dust removing control section executes the dust removing mode after stopping an operation of an air conditioning function, and wherein said dust removing control section drives, in the dust removing mode, the fan at a rotation speed sufficient for suppressing increase of temperature within said air conditioner heated by said heating section.

* * * * *